United States Patent [19]

Crenshaw et al.

[11] Patent Number: 4,731,505

[45] Date of Patent: Mar. 15, 1988

[54] IMPACT ABSORBING JACKET FOR A CONCENTRIC INTERIOR MEMBER AND COAXIAL CABLE PROVIDED WITH SAME

[75] Inventors: Randall W. Crenshaw; Michael K. Drum, both of Conover, N.C.

[73] Assignee: General Instrument Corporation, New York, N.Y.

[21] Appl. No.: 33,333

[22] Filed: Mar. 31, 1987

[51] Int. Cl.[4] ..... H01B 7/24; H01B 17/58

[52] U.S. Cl. ..... 174/107; 138/110; 138/115; 174/136

[58] Field of Search ..... 174/15 C, 28, 107, 136, 174/167; 138/103, 110, 115; 74/551.9

[56] References Cited

U.S. PATENT DOCUMENTS 504,397 9/1893 Marsh ..... 174/28

FOREIGN PATENT DOCUMENTS 233608 4/1961 Australia ..... 174/15 C 2200606 7/1973 Fed. Rep. of Germany ..... 138/115

55-142143 11/1980 Japan ..... 74/551.9

8005762 4/1981 Netherlands ..... 138/115

478517 1/1938 United Kingdom ..... 174/107

967012 8/1964 United Kingdom ..... 174/28

1068970 5/1967 United Kingdom ..... 174/28

OTHER PUBLICATIONS (S3103 0013) *Research Disclosure, No. 106, Feb. 1973 p. 10612.*

*Primary Examiner*—Laramie E. Askin

*Attorney, Agent, or Firm*—Barry R. Lipsitz

[57] ABSTRACT

A new jacketing construction for use with coaxial cables provides an improved level of crush and impact resistance. The jacketing construction comprises a plurality of circumferentially spaced tubes each having a nonsymmetrical cross-sectional geometry such that under load, a portion of any radially transmitted force will be dissipated.

12 Claims, 7 Drawing Figures

IMPACT ABSORBING JACKET FOR A CONCENTRIC INTERIOR MEMBER AND COAXIAL CABLE PROVIDED WITH SAME

TECHNICAL FIELD

This invention relates to protective sheaths for data transmission cables and more particularly, to outer jacketing materials having impact absorbing properties.

BACKGROUND OF THE INVENTION

Protective jacketing for transmission cables is well known in the art. For many years, the cable industry has relied on the jacketing developed for use with telephone cables. The existing types of protective cable jackets include those made from steel armor and rubberized jacketing materials. Steel armored cables provide good resistance against crushing, penetration by rodents, as well as improved corrosion resistance and good low frequency shielding. Unfortunately, steel armored cables are very expensive to manufacture since they require additional fabrication steps, and are therefore somewhat over engineered for use in cable television systems. For example, many cable TV cables require crush and corrosion resistance but rarely need rodent protection or low frequency shielding.

Conventional coaxial cables, while providing good corrosion protection as well as being lightweight and having a small bend radius, are burdened by the disadvantages of poor cut-through resistance, low impact resistance and little or no crush or deformation resistance. Armored cables are additionally burdened by large bend radius and an inherent stiffness that makes the cable quite awkward to handle. Moreoever, an armored jacket is much more difficult to remove for interconnection of the cable than is the elastomeric/plastic (e.g., polyolefin) jacket of a conventional coaxial cable.

It would be advantageous to provide a new protective cable jacket construction specifically adapted to the needs of cable TV and similar industries. Such an improved cable jacket construction should exhibit improved crush and high impact resistance while being inexpensive, easy to handle, and inexpensive to deploy. The present invention provides such a cable jacket.

SUMMARY OF THE INVENTION

An object of the present invention is to provide a new protective jacket construction with improved crush and high impact resistance.

According to the present invention, impact protection for a concentric interior member such as a cable is provided by a jacket comprising a plurality of deformable tubular elements which are longitudinally positioned about the circumference of the interior member. The tubular elements have a nonsymmetrical cross section geometry with respect to intersecting radii of the interior member.

According to another aspect of the present invention, a cable for use in transmitting electromagnetic signals includes a linear central electrical conductor and electrical insulating layer which is concentric with and encompasses the inner electrical conductor. An outer electrical conductor is provided to be concentrically encompassing the inner insulator. Also included is an outer jacketing formed from a deformable material that has a plurality of spaced tubular elements longitudinally positioned about the circumference of the outer electrical conductor. The tubular elements are formed to have an irregularly shaped geometric cross section.

DESCRIPTION OF THE PREFERRED EMBODIMENT

Figure 1:
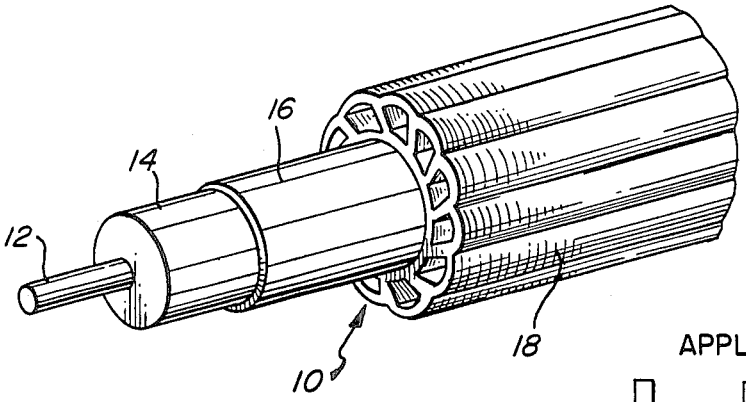
FIG. 1 is a perspective illustration of a portion of a cable having an impact absorbing jacket provided according to the present invention.

Referring now to FIG. 1, there is illustrated in perspective a portion of a cable having an impact absorbing cable jacket provided according to the present invention. The cable 10 includes center conductor 12 which is coaxial with an electrical insulative sheath 14. An outer conductive layer 16 is provided, as is conventional. The cable also includes an outer impact absorbing jacket 18 which is detailed hereinafter.

Until recently, the cable TV industry has been content to adapt existing telephone cable technology for use in constructing cables for cable TV systems. Although both telephone and cable TV systems involve signal transmission over coaxial lines, the requirements for each are different. Cable TV systems typically transmit the signals in the video range and therefore are less likely to need extensive low frequency shielding. In many applications, cable TV cables are placed where rodent damage is not a significant concern. Consequently, a conventional armored steel coaxial cable may be over engineered for some cable TV applications. On the other hand, conventional coaxial cable does not provide the impact resistance that is needed for cable TV applications.

An impact absorbing cable jacket provided according to the present invention provides improved resistance to damage from impacts without the added cost and burdensome handling problems associated with armored steel cables.

Figure 2:
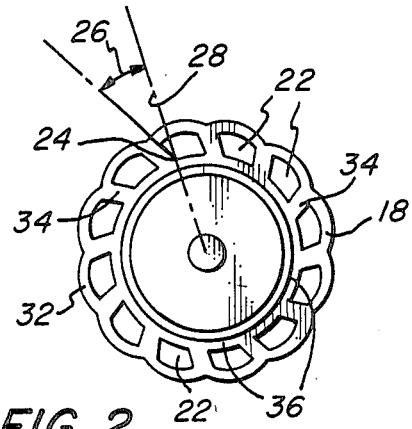
FIG. 2 is an illustration in section of the impact absorbing jacketing of FIG. 1.

Referring now to FIG. 2, there is illustrated in section a portion of the cable of FIG. 1. Impact absorbing jacketing 18 is seen to comprise, in the preferred embodiment, a plurality of longitudinal hollow tubes 22 formed of a polyethylene, such as linear medium density polyethylene, or other deformable and extrudable material. The longitudinal tubes are spaced circumferentially around the coaxial cable portion such as outer conductor 16.

In section, the cross-sectional geometry of the tubes is revealed to be a variation of a conventional arch or cylindrical type tube. In a cylindrical type tube (not shown), the impact of an applied force would be symmetrically distributed around each tube and passed radially onto the inner conductive material. Consequently, any shock or impact absorbing characteristics of the jacket would be provided primarily by the compressability of the material, as opposed to the geometry of the tube itself.

Figure 3:
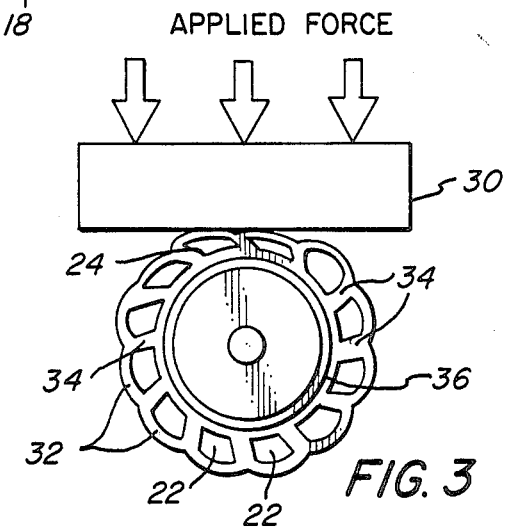
FIG. 3 is an illustration showing the deformation of the jacket of FIG. 2 due to an applied load.

The improvement provided by the impact absorbing jacket of the present invention can be seen by reference to FIGS. 2 and 3 together. The tubular cross-sectional geometry is modified such that it is irregular or nonsymmetrical about an intersecting radius of the cable, e.g, radius 28 shown in FIG. 2. A regular tube geometry, such as an oval, can also be used if the tubes are oriented at an angle within the wall of the jacket such that the cross-sectional shape of the tubes is asymmetrical with respect to intersecting radii of the cable being protected.

As shown in FIG. 2, each portion of the outer wall 32 spanning two adjacent support walls 34 is arch-shaped with a radius of curvature less than the average distance between the outer wall and the center of the jacket or cable; and the radial axis of each arch-shaped portion is non-radial of the jacket or cable.

When under load, a force 30 is applied across a portion of the cable and the jacketing deforms to increase the angle 26 that the compressed tube edge forms with an intersecting cable radius 28. As a result of the modified cross-sectional geometry of the tubes, the force is not passed directly through the cable jacketing onto the inner layers. Rather, a portion of the compressive radial force is converted to a sheer force in the jacketing material. Thus, the total applied force to the inner cable portions is substantially reduced.

In the preferred embodiment, the jacket material comprises polyethylene formed using a one-piece extrusion method, although those skilled in the art will note that other conventional deformable materials and extrusion methods may be equivalently substituted. For example, if the modulus of elasticity of the jacketing material is low (i.e., the material is spongy), the angle 26 may be selected to approach 80° to 90°. Conversely, if the modulus of elasticity of the jacketing material is high, the angle 26 will be selected to be smaller, e.g., approximately 45°. Note how a cable jacket provided according to the present invention can be tailored to have a selected impact on static load resistance by careful selection of the cross-sectional shape of the tube in combination with the modulus of elasticity of the jacket material.

In the specific embodiment illustrated outer tube wall portion 32 is approximately 30–40 mils thick. Similarly, inner tube wall portion 36 of the jacket is approximately 30–40 mils thick. As clearly illustrated in the drawing (e.g. FIG. 2), the thickness of each support wall 34 is greater than the thickness of the outer wall 32. The support walls are preferably configured with approximate 30° radial spacing. The interiors of the tubes 22 contain air and are about 75 mils high. In an alternate embodiment (not shown), the outer and inner tube walls are 30–40 mils thick, with 15–20 mil support walls present at 15° radial spacing and an interior air space approximately 40–50 mils thick. The angle of the support walls is approximately 60°. The dimensions given above are for purposes of illustration only, and many other configurations will be apparent to those skilled in the art.

Figure 4A:
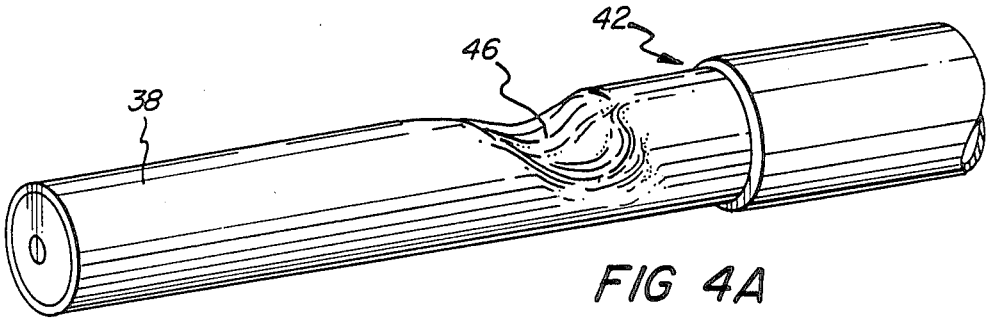
FIGS. 4A and 4B are perspective illustrations of the deformation due to an impact force for a conventional jacketed cable and a cable having the jacket of FIG. 2, respectively.
Figure 4B:
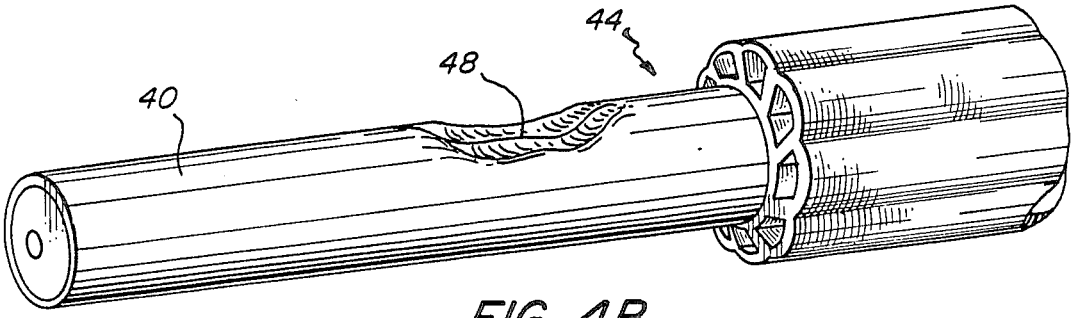

In FIGS. 4A and 4B, there are illustrated impact test results which show the extent of deformation in a cable having conventional jacketing (FIG. 4A) and a cable having an impact absorbing jacketing according to the present invention (FIG. 4B). Visual comparison between FIGS. 4A and 4B shows that the inner portions 38 and 40 of the cables 42 and 44, respectively, are deformed but the area of deformation 46 in FIG. 4A is substantially greater than 48 of FIG. 4B.

Figure 5:
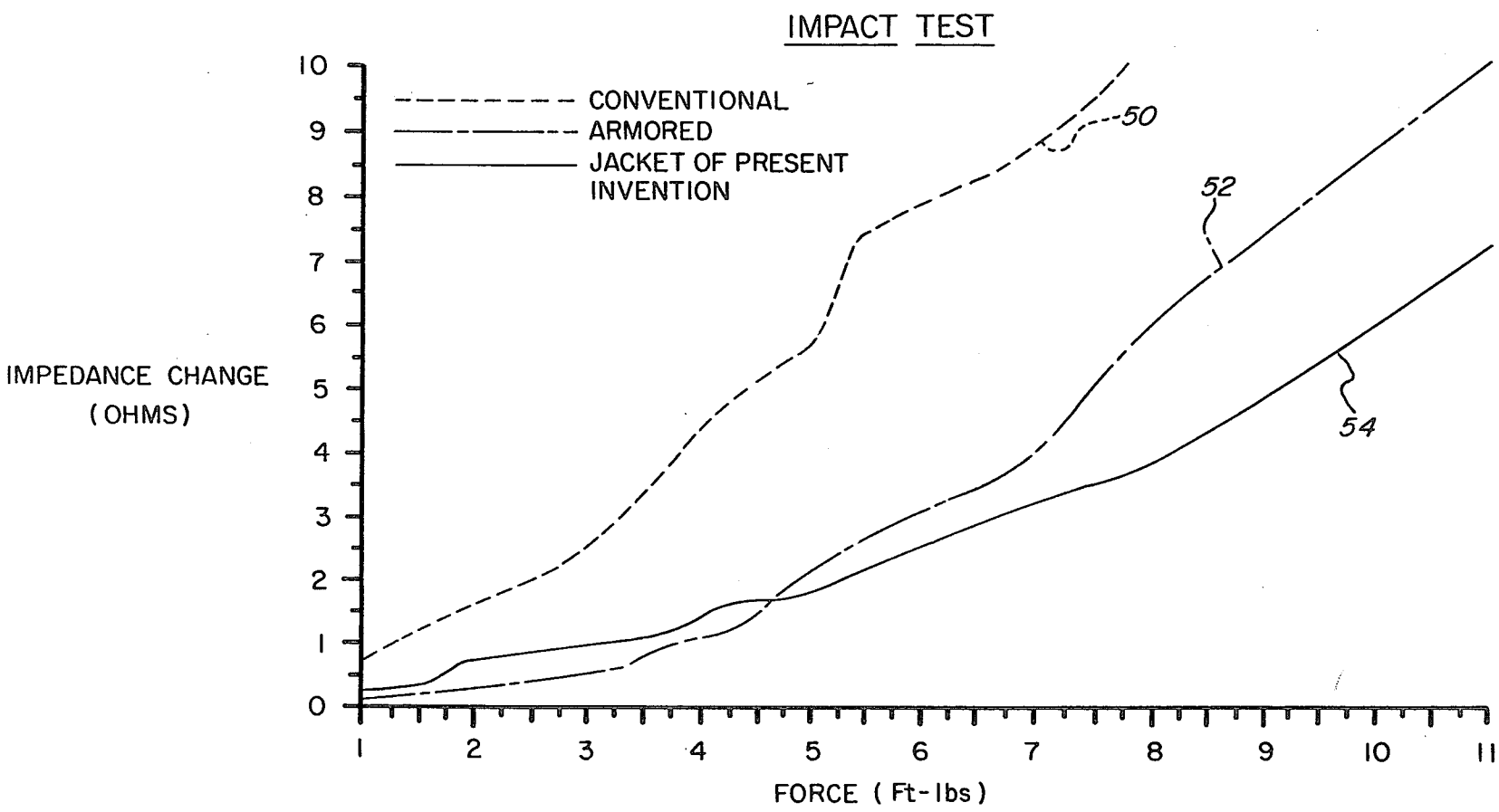
FIG. 5 is a graphical illustration detailing the change in electrical impedance as a function of impact force for a cable having three different types of protective jacketing.

FIG. 5 is an illustration of the electrical impedance change in three cables as a function of impact force. Curve 50 and curve 52 correspond, respectively, to conventional jacketed and armor jacketed conventional cables. Curve 54 demonstrates the improvement in impact resistance over the other two cables provided by the present invention. Note that the impedance change is significantly less with a cable having an impact absorbing jacketing provided according to the present invention.

As can be seen in FIG. 5, the conventional cable jacket provides limited impact protection. The armored cable provides a much higher level of protection but as higher forces are applied, percent change in impedance vs. impact (in foot-pounds) increases significantly. At low impact, the cable jacket provided according to the present invention behaves much like an armored cable jacket. However, with high impact forces, the slope of the curve is more gradual. This difference can be understood by reference to the manner in which the individual tubes are deflected. As the impact force increases, the amount of folding of the tubes tends to increase, distributing the applied force not only around the cable circumference but also perpendicularly to the point of impact along the cable length. Finite elemental analysis reveals, for a given impact force applied to a cable with a jacket provided according to the present invention, that up to 65 percent of the applied force is dissipated before reaching the outer conductor of the cable. The analysis also reveals for a conventional rubberized jacketed cable 95 percent of the impact applied to the jacket is transmitted to the outer conductor of the cable.

Figure 6:
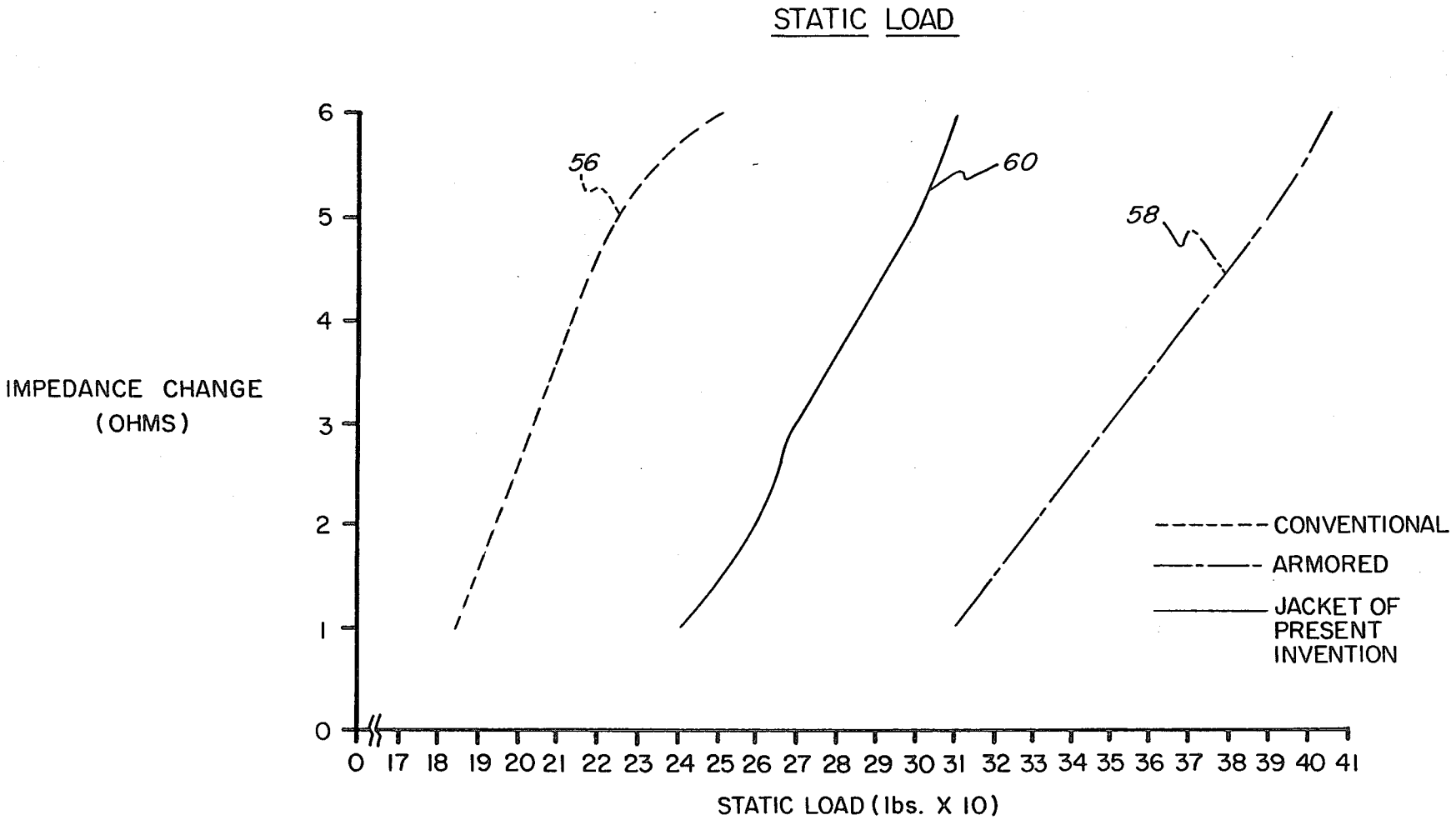
FIG. 6 is a graphical illustration detailing the change in electrical impedance as a function of static load for three cables having the three different types of protective jacketing of FIG. 5.

FIG. 6 is an illustration showing the change in electrical impedance as a function of static load for the three cables of FIG. 5. Curve 56 and curve 58 correspond respectively to the conventional jacketed and armored cable of FIG. 5 while curve 60 corresponds to a cable having an impact absorbing jacketing provided according to the present invention. Although an impact absorbing jacketing does not provide as good protection against static load induced electrical impedance changes as does a conventional armored cable, the performance with respect to this parameter is quite acceptable, and represents an improvement over conventional jacketed coaxial cables.

Those skilled in the art will also note that additional layers of jacketing may be provided to improve the impact absorbing characteristics of this cable. In addition, conventional cable "flooding" compounds may be used to improve the integrity of the cable.

The performance advantages of a cable having an impact absorbing jacketing provided according to the present invention can be further seen by reference to the following table which compares the performance of a conventional coaxial cable with an armored jacketed one relative to a coaxial cable with an impact absorbing jacket provided according to the present invention.

TABLE 1

| Performance Comparison: | 500 Standard Coaxial Jacket (Medium Density PE) | 500 Armored Jacket (2 Medium Density PE Jackets Plus .006 Steel Tape) | Cable Having a Jacket Provided According to the Present Invention |
|---|---|---|---|
| Impact Test Impedance Change @ 5 ft/lbs. | 5.7 ohms | 2.2 ohms | 1.8 ohms |
| Impact Test Impedance Change @ 10 ft/lbs. | 14.0 ohms | 9.3 ohms | 6.0 ohms |
| Minimum Bend Radius | 8.0" | 10.5" | 8.0" |
| Direct Burial Approved | Yes | No | Yes |
| Cut Through (lbs. required to cut through to jacket drop test) | 37 lbs. | 160 lbs. | 110 lbs. |
| Prep Time (jacket removal with tool) | 1 minute | 5 minutes | 1 minute |
| Relative Cost (armored equals 100%) | 56% | 100% | 75% |
| Typical Diameter | .600 | .730 | .750 |
| Compression (static crush test 3 ohm change) | 205 lbs. | 350 lbs. | 270 lbs. |

Similarly, although the invention has been shown and described with respect to a preferred embodiment thereof, it will be understood that other changes, omissions and additions thereto may be made without departing from the spirit and scope of the invention as set forth in the following claims.

We claim:

1. A cable for use in transmitting electromagnetic signals comprising:

an inner electrical conductor;

an electrical insulating layer concentrically encompassing said inner electrical conductor;

an outer electrical conductor concentrically encompassing said insulating layer; and an outer jacket encompassing said outer electrical conductor, said outer jacket formed from a deformable material having a plurality of spaced tubular elements arranged longitudinally about said outer electrical conductor, each of said tubular elements having a cross-section which is non-symmetrical about all radii of said inner electrical conductor, and having an arch-shaped outer layer portion with a radius of curvature less than the average distance between the outer layer portion and the longitudinal axis of said cable, the radial axis of each arch-shaped outer layer portion being non-radial of said cable.

2. The cable of claim 1 wherein each of said tubular elements is air filled.

3. The cable of claim 1 wherein said jacket is formed from polyethylene.

4. A jacket for protecting an elongated member such as an electrical cable, said jacket comprising:

an inner wall of generally circular cross-section to surround and closely conform to an elongated member;

a deformable outer wall; and a plurality of deformable support walls spaced around said inner, wall, between said inner and outer walls, to support said outer wall, said plurality of deformable support walls together with said inner and outer walls defining longitudinally extending tubular chambers, each portion of said outer wall spanning two adjacent support walls being arch-shaped with a radius of curvature less than the average distance between the outer wall and the center of the jacket, and the radial axis of each of said arch-shaped portions being non-radial of the jacket.

5. A jacket as set forth in claim 4 wherein the two support walls about each tubular chamber are oriented asymmetrically about all radii of the jacket passing between said two support walls.

6. A jacket as set forth in claim 5 wherein said inner, outer and support walls are constructed as one integral body.

7. A jacket as set forth in claim 6 wherein said inner, outer and support walls are formed of an elastic material.

8. A jacket as set forth in claim 7 wherein said elastic material is polyethylene.

9. A jacket as set forth in claim 6 wherein said support walls are approximately evenly spaced circumferentially around said inner wall.

10. A jacket as set forth in claim 6 wherein said tubular chambers are filled with a non-pressurized gas, whereby said outer wall and said support walls absorb most of the external forces applied to said jacket.

11. A jacket as set forth in claim 6 wherein the thickness of each of the support walls is greater than the thickness of the outer wall.

12. A jacket for protecting an elongated member such as an electrical cable, said jacket comprising:

an inner wall of generally circular cross-section to surround and closely conform to an elongated member;

a deformable outer wall; and a plurality of deformable support walls spaced around said inner wall, between said inner and outer walls, to support said outer wall, said plurality of deformable support walls together with said inner and outer walls defining longitudinally extending tubular chambers, each portion of said outer wall spanning two adjacent support walls being arch-shaped and the radial axis of each of said arch-shaped portions being non-radial of said jacket.

* * * * *